US005317822A

United States Patent [19]

Johnson

[11] Patent Number: 5,317,822

[45] Date of Patent: Jun. 7, 1994

[54] ATHLETIC SHOE WITH INTERCHANGEABLE WEAR SOLE

[76] Inventor: Joshua F. Johnson, 1515 Appleton, No. 3, Long Beach, Calif. 90802

[21] Appl. No.: 962,739

[22] Filed: Oct. 19, 1992

[51] Int. Cl.[5] ..... A43B 3/24; A43C 13/00

[52] U.S. Cl. ..... 36/101; 36/15; 36/132

[58] Field of Search ..... 36/15, 41, 42, 36 R, 36/62, 100, 101, 132; 24/573.1, 573.2, 573.7

[56] References Cited

U.S. PATENT DOCUMENTS

| | | | |
|---|---|---|---|
| 729,371 | 5/1903 | Lutz . | |
| 818,173 | 4/1906 | Hoffman | 36/15 |
| 1,918,639 | 7/1933 | Greentree | 36/15 |
| 2,528,951 | 11/1950 | Epsztejn | 36/15 |
| 2,664,650 | 1/1954 | Sabbagh | 36/15 |
| 3,332,158 | 7/1967 | Grimaudo | 36/42 |
| 3,538,628 | 11/1970 | Einstein, Jr. | 36/100 |
| 3,866,339 | 2/1975 | Latto | 36/15 |
| 3,902,259 | 9/1975 | Cracco | 36/101 |
| 4,150,499 | 4/1979 | Wang | 36/100 |
| 4,267,650 | 5/1981 | Bauer | 36/101 |
| 4,317,294 | 3/1982 | Goodyear | 36/100 |
| 4,337,042 | 3/1983 | Bauer | 36/15 |
| 4,366,633 | 1/1983 | Flottorp | 36/101 |
| 4,377,042 | 3/1983 | Bauer | 36/101 |
| 4,570,363 | 2/1986 | Annovi | 36/117 |
| 4,745,693 | 5/1988 | Brown | 36/15 |
| 4,839,948 | 6/1989 | Boros | 36/101 |
| 4,887,369 | 12/1989 | Bailey et al. | 36/101 |
| 4,936,028 | 6/1990 | Posacki | 36/15 |

FOREIGN PATENT DOCUMENTS

| | | | |
|---|---|---|---|
| 802801 | 2/1951 | Fed. Rep. of Germany | 36/15 |
| 7807177 | 1/1980 | Netherlands | 36/101 |
| 8604489 | 8/1986 | PCT Int'l Appl. | 36/15 |

*Primary Examiner*—Paul T. Sewell
*Assistant Examiner*—M. D. Patterson
*Attorney, Agent, or Firm*—Howard A. Kenyon

[57] ABSTRACT

An athletic shoe with an interchangeable wear sole which can be selected to match a specific sport, is disclosed. An upper portion of the athletic shoe is designed for an individual foot of a particular wearer. This upper portion of the athletic shoe contains an attached upper sole which has molded on the bottom surface a plurality of strategically placed protruding resilient knobs and a protruding resilient edge rail which engages knob chambers and a rail slot located on the upper surface of the wear sole. VELCRO surface on the upper sole and the wear sole also are engaged. Interlocking devices on the edge of the upper sole and wear sole are pinned together. The above combination holds the selected wear sole firmly on the upper sole attached to the upper portion of the athletic shoe.

7 Claims, 2 Drawing Sheets

ATHLETIC SHOE WITH INTERCHANGEABLE WEAR SOLE

BACKGROUND OF THE INVENTION

1. Field of the Invention

A replaceable wear sole for an athletic shoe is described. More specifically a wear sole having a tread design that is efficient for a given sport that can be easily and quickly attached is described.

2. Description of the Prior Art

With the high cost of todays athletic shoes it becomes almost prohibitive to purchase an athletic shoe for each desired sport. Since the soles wear out faster than the upper portion of the shoe, a wear sole that can be easily removed and replaced having a tread design for a specific sport would be cost effective to the wearer of an athletic shoe.

There have been numerous attempts to have a removable and replaceable wear sole. Some of these are U.S. Pat. No. 1,918,639 to Greentree, U.S. Pat. No. 4,745,693 to Brown, U.S. Pat. No. 4,936,028 and U.S. Pat. No. 4,377,042. None of the above patents have been successful since the patented items are not available. What is needed is a inexpensive wear sole that can be easily and quickly attached to an upper sole when there is a new tread requirement.

The present invention provides such a need in that an inexpensive wear sole can be molded to fit an expensive upper shoe portion. In this manner a variety of tread on the wear sole could fulfill the requirements of an athlete without having to buy several expensive shoes.

SUMMARY OF THE INVENTION

It is the primary object of the invention to provide a removable and replaceable wear sole on the upper portion of a athletic shoe.

It is another object of the invention to provide a wear sole to be removed and replaced, the wear sole having a different tread design for each sport.

It is still another object of the invention to provide fastening means between the wear sole and the upper portion of the shoe that will not allow any lateral movement.

Briefly, in accordance with the invention, there is provided an upper portion of an athletic shoe having an upper sole separated from the wear sole. A plurality of fastening devices are provided between the upper sole attached to the upper portion of the shoe and the wear sole. The fastening devices of the invention are sufficient to prevent any lateral movement when the athlete is using the shoe. A tread design, configured for a specific sport, which is molded into the wear sole provides the athlete with the efficiency he would obtain if he had a separate pair of shoes for each sport.

Other objects and advantages will become apparent from the following description and appended claims taken in conjunction with the accompanying drawings.

The novel features which are believed to be characteristic of the invention as to the system together with further objects and advantages thereof, will be better understood from the following description in connection with the accompanying drawings in which the presently preferred embodiments of the invention is illustrated by way of example. It is to be expressly understood, however, that the drawings are for purposes of illustration and description only, and are not intended as a definition of the limits of the invention.

DETAILED DESCRIPTION OF THE PREFERRED EMBODIMENT

Figure 1:
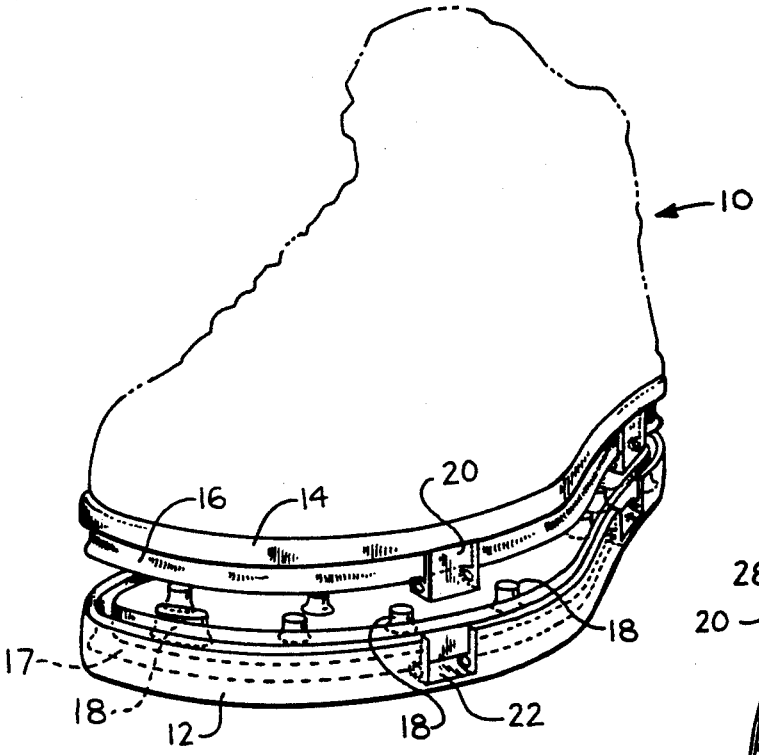
FIG. 1 which is a perspective view which shows the upper portion of an athletic shoe and the wear sole separated.

Turning now to FIG. 1 there is seen the upper portion of the shoe assembly generally shown as 10 that contains the wearers foot. An interchangeable wear sole 12 is also shown in this view which contains the tread design (not shown) for a specific sport. Also seen in this view is the edge of the upper sole 14. An edge of the rails 16 and rail slot 17 are also seen in this view. FIG. 1 shows knob chambers 18, upper lock bracket 20 and a lower lock bracket 22.

Figure 2A:
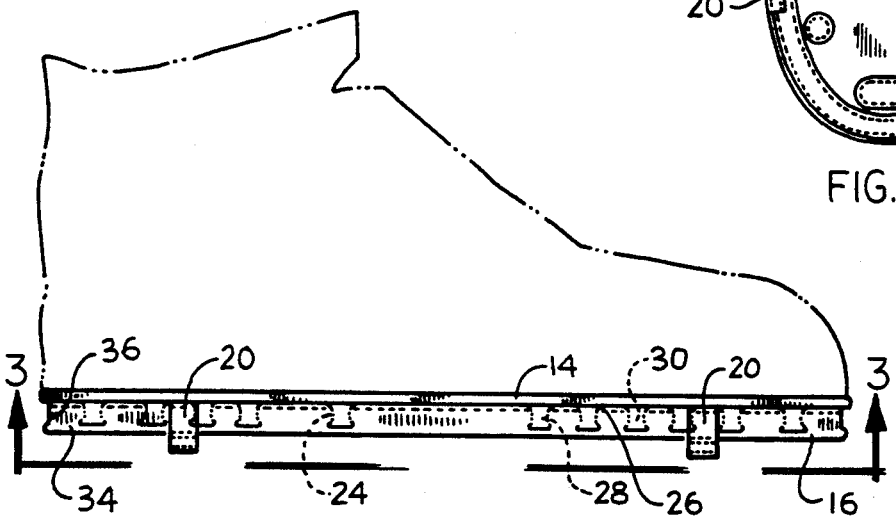
FIG. 2A is a side view showing the upper portion of the athletic shoe, the upper sole and fastening devices attached to the upper sole.

FIG. 2A is a side view of the upper sole 14 showing a side view of rail 16 and knobs 24. The knobs 24 have a small radius 26 at the point where the knobs 24 are attached to the upper sole 14. This radius 26 helps reduce the stress load concentration induced by the lateral force between the wear sole 12 and the upper sole 14. A side view of the upper brackets 20 is also seen.

Figure 3:
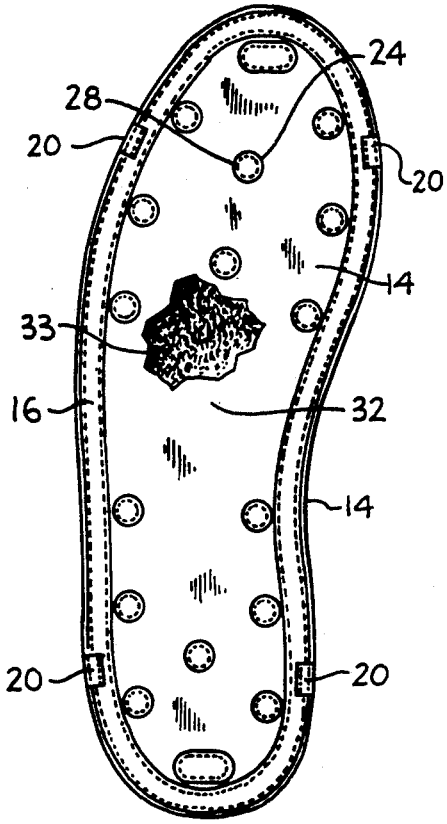
FIG. 3 is a view taken from FIG. 2A of the bottom of the upper sole which also shows a portion of Velcro.

FIG. 3 is a plan view of the lower surface of the upper sole showing a plurality of knobs 24 spaced on the upper sole 14. As is seen by the dotted line around each knob 24, the stem portion 28 of the knob 24 is smaller in diameter than the end portion 30. This difference is seen clearly in FIG. 2A. This difference will provide a snug fit of knobs 24 fitting into knob chambers 18. Also, the surface 32 of upper sole 14 is covered with VELCRO 33 bonded to surface 32 and is the hook fastener. Upper lock brackets 20 can also be seen in this view. The rails 16 can also be seen in this view and it is noted by the dotted line that the end portion of the rail 34 is larger in width than the body portion 36. This difference can be clearly seen in FIG. 2A. This difference will provide a snug fit of the rail fitting into rail slot 17.

Figure 2B:
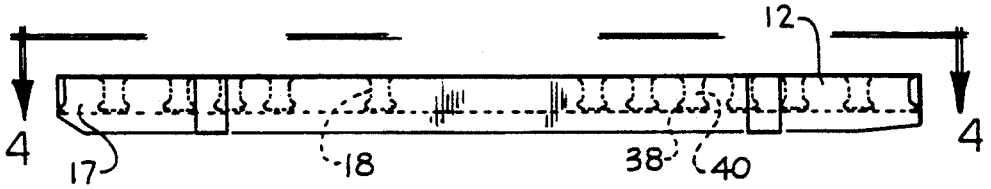
FIG. 2B is a side view of the wear sole showing the fastening device attached to the wear sole which also shows a portion of Velcro.
Figure 4:
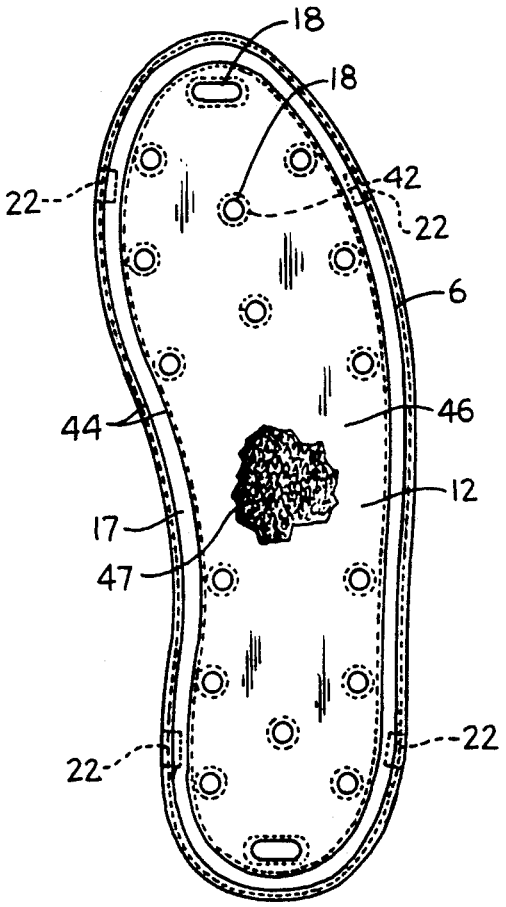
FIG. 4 is a view taken from FIG. 2B showing the top of the wear sole.

FIG. 2B shows a side view of the wear sole 12 and knob chambers 18. As is noted the bottom diameter 38 of the knob chambers 18 is larger diameter than the middle portion 40. This provides a mating relationship between knobs 24 and knob chambers 18. Rail slots 17 can also be seen in this view. FIG. 4 is a plan view of the upper surface of the wear sole 12 that shows a plurality of knob chambers 18 spaced on the wear sole. The dotted line 42 shows that the bottom portion of the knob chamber 38 is larger than the middle portion 40 as seen in FIG. 2B. As seen two knob chambers on each end of the wear sole are of a different shape than the rest. This allows for some twisting freedom if required by the athlete. The rail slot 17 is also seen in this view. The rail slot 17 is also larger in width in the bottom portion than the body portion as seen by the dotted line. This provides a snug fit between the rail 16 and the rail slot 17. Lower lock bracket 22 can also be seen in this view. Also, the surface 46 of wear sole 12 is covered with VELCRO 47 bonded to surface 46 and is the loop fastener. The knobs, knob chambers, rails and rail slots are made from flexible nylon plastic or some other suitable material.

Figure 5:
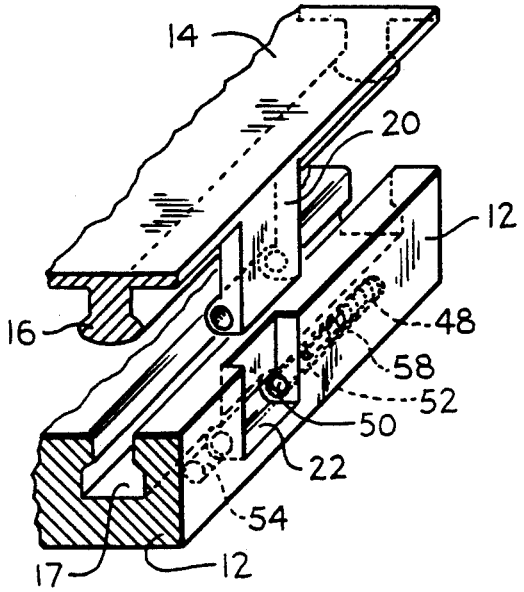
FIG. 5 is a perspective cut of the edge of the wear sole and the upper sole showing upper and lower lock brackets and mechanism with the fastening means not engaged.
Figure 6:
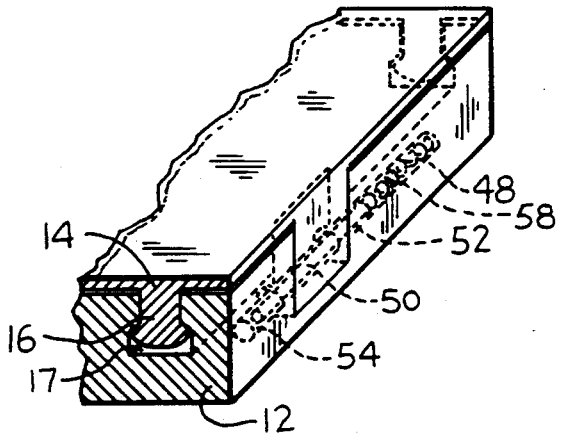
FIG. 6 is a perspective cut of the wear sole and the upper sole with the fastening means engaged.
Figure 7:
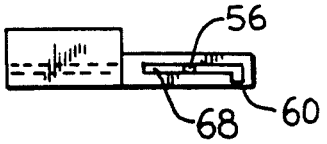
FIG. 7 is a side view, isolated, showing a slot and a notch that contains a locking pin lever.

Turning now to FIG. 5 there is seen the pin mechanism that assists in holding the upper sole to the wear sole. The upper sole 14 and wear sole 12 are not attached in this view. Upper lock 26 bracket 20 and lower lock bracket 22 are in mating relationship when the wear sole 12 is fitted to the upper sole 14. In this view FIG. 5 there is seen compression spring 48, pin 50, forward pin chamber 52 and rear pin chamber 54. The present invention has 4 of the pin mechanisms located around the periphery of the athletic shoe. A locking pin lever 56 in FIG. 7 is attached to the locking pin 50. The locking pin lever 56 is moved in locking pin lever slot 58 while compressing spring 48. The locking pin lever 56 is moved into locking pin lever slot notch 60 when spring 48 is fully compressed. When all 4 springs are compressed, upper lock bracket 20 can fit into lower lock bracket 22. Simultaneously, the knobs 24 will fit into the knob chambers 18, the rails 16 will fit into the rail slots 17, and the VELCRO on surface 32 will engage the VELCRO on surface 46. This configuration is partially shown in FIG. 6. FIG. 6 shows the rail 16 and rail slot 17 in mating relationship bringing upper sole 14 and wear sole 12 together. Also shown is the pin 50 having been released by moving locking pin lever 56 out of notch 60 and the compression spring 48 moving the pin 50 from the forward pin chamber 52 through upper lock bracket 20 into rear pin chamber 54 to lock the upper sole 14 to the wear sole 12. The upper and lower lock brackets 20 and 22 are made from flexible nylon plastic or some other suitable material and the forward pin chamber 52, the rear pin chamber 54, the locking pin 50, the compression spring 48 and the locking pin lever 56 are all of a metallic material.

Thus, it is apparent that there has been provided in accordance with the invention an athletic shoe with replaceable wear soles that fully satisfies the objectives, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and scope of the appended claims.

What is claimed is:

1. An athletic shoe adapted to receive a replaceable wear sole having a bottom tread such that the wear sole can be changed depending on the tread required by a specific sport comprising:

an upper portion of said athletic shoe designed to fit the foot of the user;

an upper sole having an upper and lower surface, said upper surface being permanently attached to the upper portion of said athletic shoe, said upper sole having lower surface fastening means, said lower surface fastening means further comprising:

a plurality of protruding resilient knobs on said lower surface of said upper sole, said knobs having a stem portion and an end portion, said stem portion being smaller in diameter than said end portion;

a protruding resilient rail located along the edge of the lower surface of said upper sole, said rail having an end portion and a body portion, said end portion being larger in width than said body portion:

hook fastener material bonded to said lower surface of said upper sole;

a plurality of interlocking devices fitted on the edge of said upper sole;

a wear sole having an upper and lower surface, said wear sole having a specific tread design on said lower surface, said wear sole further comprising:

a plurality of resilient knob chambers located on said upper surface of said wear sole, said knob chambers having a bottom portion and a middle portion, said bottom portion being larger in diameter than said middle portion;

a resilient rail slot located along the edge of said upper surface of said wear sole, said rail slot having a bottom portion and a body portion, said bottom portion being larger in width than said body portion;

loop fastener material bonded to said upper surface of said wear sole;

a plurality of interlocking devices attached to the edge of said upper surface of said wear sole, said interlocking devices further comprising:

a upper locking bracket located on each side of said upper sole;

a lower locking bracket located on each side of said wear sole designed to position said upper locking bracket inside said lower locking bracket;

a forward locking pin cylindrical chamber attached to one side of said lower locking bracket;

a rear locking pin cylindrical chamber attached to the other side of said lower locking bracket, said rear pin chamber being in alignment with said forward pin chamber;

a locking pin lever slot, said locking pin lever slot parallel to said rear locking pin cylindrical chamber;

a locking pin lever slot notch located at the end of said locking pin lever slot, said locking pin lever slot notch being perpendicular to said locking pin lever slot;

a locking pin located inside of said rear locking pin cylindrical chamber, said locking pin being in alignment with said rear locking pin cylindrical chamber and said forward locking pin cylindrical chamber;

a locking pin lever attached to said locking pin such that said locking pin lever protrudes from said locking pin lever slot;

a compression spring inside said rear pin cylindrical chamber, said compression spring surrounding said locking pin, said compression spring attached on one end to the middle of said rear locking pin cylindrical chamber and on the other end to said locking pin.

2. An athletic shoe as described in claim 1 wherein said knobs, knob chambers, rails, rail slots, are all made from flexible nylon plastic.

3. An athletic shoe as described in claim 1 wherein said upper and lower locking brackets, are made from flexible nylon plastic and the forward pin cylindrical chambers, rear pin cylindrical chambers, locking pins, locking pin levers and compression springs are all made from a metallic material.

4. An athletic shoe as described in claim 1 wherein said knobs and knob chambers, said rails and rail slots, said upper and lower bracket, said hook fasteners and loop fasteners, are all designed to mate simultaneously.

5. A method of attaching a wear sole of specific configuration, depending on the tread required of a specific sport, to an athletic shoe comprising:

providing an upper portion of said athletic shoe designed to fit the foot of the use;

providing an upper sole having an upper and lower surface, said upper sole being permanently adhesively attached to the upper portion of said athletic shoe;

locating a plurality of resilient knobs on said lower surface of said upper sole;

locating a protruding resilient rail along the edge of the lower surface of said upper sole;

fitting a plurality of interlocking devices on the edge of said upper surface of said wear sole;

fitting a plurality of interlocking devices on the edge of said lower surface of said upper sole;

attaching an upper locking bracket to said upper sole;

attaching a lower locking bracket to said lower sole, said lower locking bracket designed to position said upper locking bracket inside said lower locking bracket;

attaching hook fastener material adhesively to said lower surface of said upper sole;

fitting a plurality of interlocking devices on the edge of said lower surface of said upper sole;

providing a wear sole having an upper and lower surface, said wear sole having a specific tread on said lower surface;

locating a plurality of resilient knob chambers on said upper surface of said wear sole;

locating a resilient rail slot along the edge of said upper surface of said wear sole;

attaching loop fastener material adhesively to said upper surface of said wear sole; and attaching a forward locking pin cylindrical chamber to said lower locking bracket;

attaching a rear locking pin cylindrical chamber to said lower locking bracket, said forward pin cylindrical chamber and said rear pin cylindrical chamber being in alignment;

fitting a locking pin inside said rear pin cylindrical chamber;

attaching a locking pin lever to said locking pin;

providing a locking pin lever slot in said rear pin cylindrical chamber, said locking pin lever slot being parallel to said rear locking pin cylindrical chamber, said locking pin cylindrical chamber also having a locking pin slot notch perpendicular to said locking pin lever slot;

locating a compression spring around said locking pin inside said rear locking pin cylindrical chamber whereby moving said locking pin lever in said locking pin slot and urging said locking pin lever into said locking pin lever slot notch compresses said compression spring and moves said locking pin into said rear pin cylindrical chamber allowing said upper locking bracket and said lower locking bracket to mate.

6. A method of attaching a wear sole to an athletic shoe as described in claim 5 wherein said knob chambers on said upper surface of said wear sole are in mating relationship with said knobs on said lower surface of said upper sole and said rail slots on said upper surface of said wear sole are in mating relationship with said rails on said lower surface of said upper sole and said hook surface on said lower surface of said upper sole is in mating relationship with said loop surface on said upper surface of said wear sole, whereby when said knobs are urged into said knob chambers, said rails are urged in said rail slots and said hook and loop surfaces are forced together, the combination will help prevent lateral movement between said upper sole and said wear sole.

7. A method of attaching a wear sole to an athletic shoe as described in claim 5 wherein releasing said locking pin by urging said locking pin lever out of said locking pin slot notch allows said compression spring to move said locking pin through said upper locking bracket and said lower locking bracket into said forward pin cylindrical chamber therefore providing a positive lock of said wear sole to said upper sole.

* * * * *